US008792797B2

(12) United States Patent
Ikebuchi et al.

(10) Patent No.: US 8,792,797 B2
(45) Date of Patent: Jul. 29, 2014

(54) FIXING DEVICE, IMAGE FORMING APPARATUS, AND HEATER CONTROL METHOD

(75) Inventors: Yutaka Ikebuchi, Kanagawa (JP); Masaaki Yoshikawa, Tokyo (JP); Kenji Ishii, Kanagawa (JP); Hiroshi Yoshinaga, Chiba (JP); Yuji Arai, Kanagawa (JP); Hiromasa Takagi, Tokyo (JP); Naoki Iwaya, Tokyo (JP); Tetsuo Tokuda, Kanagawa (JP); Yoshiki Yamaguchi, Kanagawa (JP); Ippei Fujimoto, Kanagawa (JP); Takuya Seshita, Kanagawa (JP); Arinobu Yoshiura, Kanagawa (JP); Takahiro Imada, Kanagawa (JP); Hajime Gotoh, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 60 days.

(21) Appl. No.: 13/410,821

(22) Filed: Mar. 2, 2012

(65) Prior Publication Data

US 2012/0224878 A1 Sep. 6, 2012

(30) Foreign Application Priority Data

Mar. 4, 2011 (JP) ..... 2011-047913

(51) Int. Cl.
*G03G 15/20* (2006.01)

(52) U.S. Cl.
USPC ..... 399/70; 399/67; 399/69; 327/175

(58) Field of Classification Search
USPC ..... 399/67, 69, 70; 327/175
See application file for complete search history.

(56) References Cited

U.S. PATENT DOCUMENTS

| | | | |
|---|---|---|---|
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,881,927 | B2 | 4/2005 | Yoshinaga et al. |
| 6,882,820 | B2 | 4/2005 | Shinshi et al. |

(Continued)

FOREIGN PATENT DOCUMENTS

| | | | | |
|---|---|---|---|---|
| JP | 03160651 A | * | 7/1991 | ..... G11B 15/467 |
| JP | 11-161098 A | | 6/1999 | |

(Continued)

*Primary Examiner* — David Gray
*Assistant Examiner* — Francis Gray
(74) *Attorney, Agent, or Firm* — Harness, Dickey & Pierce, P.L.C.

(57) ABSTRACT

A fixing device includes a fuser member, a heater, a thermometer, and a power supply controller. The fuser member is subjected to heating. The heater is adjacent to the fuser member to heat the fuser member. The thermometer is adjacent to the fuser member to detect an operational temperature of the fuser member. The power supply controller controls power supply to the heater by adjusting a duty cycle. The controller includes a duty cycle calculator, a driver circuit, and a duty cycle modifier. The duty cycle calculator is operatively connected to the thermometer to calculate a primary value of the duty cycle based on the operational temperature. The driver circuit is operatively connected to the duty cycle calculator to supply power to the heater according to the duty cycle. The duty cycle modifier is connected between the duty cycle calculator and the driver circuit to modify the duty cycle.

12 Claims, 6 Drawing Sheets

(56) References Cited

U.S. PATENT DOCUMENTS 6,892,044 B2 5/2005 Yasui et al.
6,937,827 B2 8/2005 Katoh et al.
7,022,944 B2 4/2006 Yoshinaga et al.
7,054,570 B2 5/2006 Kishi et al.
7,116,923 B2 10/2006 Kishi et al.
7,127,204 B2 10/2006 Satoh et al.
7,130,555 B2 10/2006 Kishi et al.
7,151,907 B2 12/2006 Yoshinaga
7,209,675 B2 4/2007 Matsusaka et al.
7,212,758 B2 5/2007 Kishi et al.
7,212,759 B2 5/2007 Kishi et al.
7,239,821 B2 7/2007 Matsusaka et al.
7,239,838 B2 7/2007 Sato et al.
7,242,897 B2 7/2007 Satoh et al.
7,308,216 B2 12/2007 Kishi et al.
7,313,353 B2 12/2007 Satoh et al.
7,333,743 B2 2/2008 Kishi et al.
7,343,113 B2 3/2008 Matsusaka et al.
7,352,987 B2 4/2008 Iwata et al.
7,356,270 B2 4/2008 Matsusaka et al.
7,366,432 B2 4/2008 Kishi et al.
7,373,094 B2 5/2008 Kishi et al.
7,379,698 B2 5/2008 Yoshinaga
7,454,151 B2 11/2008 Satoh et al.
7,466,949 B2 12/2008 Satoh et al.
7,496,309 B2 2/2009 Matsusaka et al.
7,509,085 B2 3/2009 Yoshinaga et al.
7,515,845 B2 4/2009 Kishi et al.
7,519,317 B2 4/2009 Hosokawa et al.
7,546,049 B2 6/2009 Ehara et al.
7,551,869 B2 6/2009 Kishi et al.
7,565,087 B2 7/2009 Matsusaka et al.
7,570,910 B2 8/2009 Ishii
7,602,166 B1 * 10/2009 Kang ..... 323/283
7,603,049 B2 10/2009 Kishi et al.
7,609,988 B2 10/2009 Kishi et al.
7,664,410 B2 2/2010 Takagi
7,783,240 B2 8/2010 Ito et al.
7,796,933 B2 9/2010 Ueno et al.
7,801,457 B2 9/2010 Seo et al.
7,840,151 B2 11/2010 Fujimoto
7,885,569 B2 2/2011 Kishi et al.
7,912,392 B2 3/2011 Yoshinaga et al.
7,925,177 B2 4/2011 Ishii et al.
7,953,338 B2 5/2011 Takagi
7,957,663 B2 6/2011 Kishi et al.
7,983,598 B2 7/2011 Shinshi et al.
8,023,861 B2 9/2011 Yoshinaga et al.
8,064,798 B2 11/2011 Shinshi et al.
8,073,352 B2 12/2011 Kunii et al.
2002/0018663 A1 2/2002 Furukawa et al.
2002/0067936 A1 6/2002 Yasui et al.
2003/0000933 A1 1/2003 Yoshinaga et al.
2003/0007813 A1 1/2003 Yasui et al.
2003/0016963 A1 1/2003 Yoshinaga et al.
2003/0206758 A1 11/2003 Yasui et al.
2003/0215271 A1 11/2003 Yoshinaga et al.
2004/0013453 A1 1/2004 Shinshi et al.
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0025539 A1 2/2005 Yoshinaga
2005/0074251 A1 4/2005 Katoh et al.
2005/0095043 A1 5/2005 Yoshinaga et al.
2005/0123315 A1 6/2005 Kishi et al.
2005/0139584 A1 6/2005 Kishi et al.
2005/0163543 A1 7/2005 Satoh et al.
2005/0175368 A1 8/2005 Matsusaka et al.
2005/0175370 A1 8/2005 Matsusaka et al.
2005/0191078 A1 9/2005 Kishi et al.
2006/0029411 A1 2/2006 Ishii et al.
2006/0039713 A1 2/2006 Kishi et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.
2006/0116230 A1 6/2006 Satoh et al.
2006/0127118 A1 6/2006 Kishi et al.
2006/0165429 A1 7/2006 Satoh et al.
2006/0165443 A1 7/2006 Yoshinaga et al.
2006/0165448 A1 7/2006 Yoshinaga
2006/0182460 A1 8/2006 Kishi et al.
2006/0257183 A1 11/2006 Ehara et al.
2006/0285893 A1 12/2006 Ishii
2007/0014600 A1 1/2007 Ishii et al.
2007/0014603 A1 1/2007 Satoh et al.
2007/0025754 A1 2/2007 Takagi
2007/0031159 A1 2/2007 Kishi et al.
2007/0212090 A1 9/2007 Matsusaka et al.
2008/0003021 A1 1/2008 Hosokawa et al.
2008/0063443 A1 3/2008 Yoshinaga et al.
2008/0145088 A1 6/2008 Matsusaka et al.
2008/0219721 A1 9/2008 Ito et al.
2008/0226326 A1 9/2008 Seo et al.
2008/0232873 A1 9/2008 Ueno et al.
2008/0253789 A1 10/2008 Yoshinaga et al.
2008/0317532 A1 12/2008 Ehara et al.
2009/0003867 A1 1/2009 Fujimoto
2009/0067902 A1 3/2009 Yoshinaga et al.
2009/0123172 A1 5/2009 Kishi et al.
2009/0123201 A1 5/2009 Ehara et al.
2009/0123202 A1 5/2009 Yoshinaga et al.
2009/0148204 A1 6/2009 Yoshinaga et al.
2009/0169232 A1 7/2009 Kunii et al.
2009/0245865 A1 10/2009 Shinshi et al.
2009/0317113 A1 12/2009 Kishi et al.
2010/0061754 A1 * 3/2010 Ishigaya et al. ..... 399/70
2010/0074667 A1 3/2010 Ehara et al.
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064451 A1 3/2011 Yamaguchi et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176822 A1 7/2011 Ishii et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.

(56) References Cited

U.S. PATENT DOCUMENTS

| | | | | |
|---|---|---|---|---|
| 2011/0222875 | A1 | 9/2011 | Imada et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2011/0274474 | A1 | 11/2011 | Arai et al. | |
| 2011/0286758 | A1 | 11/2011 | Yoshinaga | |
| 2011/0291725 | A1* | 12/2011 | Shin | 327/175 |
| 2012/0051774 | A1 | 3/2012 | Ikebuchi et al. | |
| 2012/0112811 | A1* | 5/2012 | Cook | 327/175 |
| 2012/0114345 | A1 | 5/2012 | Fujimoto et al. | |
| 2012/0121304 | A1 | 5/2012 | Tokuda et al. | |
| 2012/0121305 | A1 | 5/2012 | Yoshikawa et al. | |
| 2013/0082795 | A1* | 4/2013 | Kris | 332/109 |
| 2013/0169330 | A1* | 7/2013 | Ma | 327/175 |

FOREIGN PATENT DOCUMENTS

| | | | |
|---|---|---|---|
| JP | 11344903 | A | 12/1999 |
| JP | 2000-029348 | A | 1/2000 |
| JP | 2005-031242 | A | 2/2005 |
| JP | 2008070686 | A | 3/2008 |
| JP | 2008139505 | A | 6/2008 |

* cited by examiner

FIXING DEVICE, IMAGE FORMING APPARATUS, AND HEATER CONTROL METHOD

CROSS-REFERENCE TO RELATED APPLICATION

This patent application claims priority pursuant to 35 U.S.C. §119 to Japanese Patent Application No. 2011-047913 filed on Mar. 4, 2011, the entire disclosure of which is hereby incorporated by reference herein.

BACKGROUND OF THE INVENTION

1. Technical Field

The present invention relates to a fixing device, an image forming apparatus, and a heater control method, and more particularly, to a fixing device for fixing an image in place on a recording medium, an image forming apparatus, such as a photocopier, facsimile machine, printer, plotter, or multifunctional machine incorporating several of those features, and a power supply control method for a heater used in such a fixing device and image forming apparatus.

2. Background Art

In image forming apparatuses, such as photocopiers, facsimile machines, printers, plotters, or multifunctional machines incorporating several of those imaging functions, an image is formed by transferring ink or toner onto a recording sheet such as a sheet of paper. The transferred, unfixed toner image may be subsequently subjected to a fixing process using a fixing device, which permanently fixes the toner image in place on the recording medium with heat and pressure.

Thermal fixing is employed in electrophotographic image formation wherein heat is imparted to a recording medium from a fixing member, in the form of an endless belt or roller, heated by an electrical heating element. Various types of control systems have been proposed to maintain a desired operational temperature of the fixing member for stabilizing performance of the fixing process.

One example is on-off feedback control which controls power supply to a heater according to readings of a thermometer detecting temperature of a fixing member. Comparing the detected temperature against a desired, set-point temperature, the on-off controller turns on the heater power supply where the detected temperature falls below the set-point temperature, and turns off the heater power supply where the detected temperature exceeds the set-point temperature. Although effective for its intended purposes, on-off feedback control is susceptible to delays in response time, which can cause the operational temperature to overshoot, resulting in undesired temperature oscillations or ripples around the set-point temperature.

A sophisticated type of feedback control employs a proportional-integral-derivative or -differential (PID) calculation to adjust a period of control cycle or on-time during which the heater is supplied with electricity. A PID controller is based on a control algorithm including a combination of proportional, integral, and derivative actions, which optimizes operational parameters of the heating system according to an error signal representing a difference between a detected temperature and a set-point temperature.

A drawback of PID control is that it can cause a large inrush current to flow into the heating element of the fixing process, particularly where the heater employed is one that consumes relatively large amounts of energy, such as a halogen heater. Inrush current surge results in fluctuations in a mains voltage from which the heater derives power, which causes lighting devices, such as fluorescent lamps and light bulbs, connected to the mains voltage in common with the printer, to flicker or dim upon activation of the heating element. Such flicker and dimming of lights are pronounced where the power supply control is designed with its control cycle shortened for precision PID calculation, resulting in frequent or large inrush current generated each time the heater enters a new control cycle.

Several methods have been proposed to alleviate drawbacks of PID-control heating. Some employ a phase-fired control that modulates a duty cycle, or phase angle, defining a ratio of on-time during which the heater is supplied with an alternating current (AC) within a given control cycle. Phase controllers operate by causing a switching element to turn on at an adjustable phase angle and turn off at a zero-crossing of the applied waveform voltage, or alternatively, by causing a switching element to turn off at an adjustable phase angle and turn on at a zero-crossing of the applied waveform voltage.

Specifically, the phase controller can "soft start" the heater, in which the duty cycle gradually ramps up to a constant level of 100% (i.e., the heater is fully turned on) after initial application of power during activation of the heater. The phase controller can also "soft stop" the heater, in which the duty cycle to gradually ramps down from 100% to a predetermined constant level upon final application of power during deactivation of the heater. Such soft start and soft stop capabilities effectively prevent inrush current from occurring each time the heater enters a new control cycle.

An arrangement of such phase control has been proposed, in which the phase controller employs an estimated frequency to determine an interval between zero-crossings of an AC power supply voltage. The zero-crossing interval is used to adjust the duty cycle during recovery from an energy-saving mode in which power supply to the controller is temporarily cut off, followed by calculating an actual frequency of the applied voltage as the power supply to the heater is fully turned on. Instead of initially obtaining the calculated, actual frequency, using the estimated frequency reduces the time required to initiate phase control of the heater, leading to accelerated start-up of the fixing process after recovery from energy-saving mode.

SUMMARY OF THE INVENTION

Exemplary aspects of the present invention are put forward in view of the above-described circumstances, and provide a novel fixing device.

In one exemplary embodiment, the fixing device includes a fuser member, a heater, a thermometer, and a power supply controller. The fuser member is subjected to heating. The heater is adjacent to the fuser member to heat the fuser member. The thermometer is adjacent to the fuser member to detect an operational temperature of the fuser member. The power supply controller controls power supply to the heater by adjusting a duty cycle defining a ratio of on-time during which the heater is supplied with electricity within a given control cycle. The controller includes a duty cycle calculator, a driver circuit, and a duty cycle modifier. The duty cycle calculator is operatively connected to the thermometer to calculate a primary value of the duty cycle based on the operational temperature detected by the thermometer. The driver circuit is operatively connected to the duty cycle calculator to supply power to the heater according to the duty cycle being input from the duty cycle calculator during operation of the heater. The duty cycle is gradually increased to the primary value upon initial application of power during activation of the heater, and gradually decreased from the primary value upon final application of power during deactivation of the heater. The duty cycle modifier is connected between the duty cycle calculator and the driver circuit to modify the duty cycle by adding an offset value to the primary value to output a modified, secondary value of the duty cycle during activation or deactivation of the heater, such that a total period of on-time divided by the control cycle during activation or deactivation of the heater equals the primary value of the duty cycle calculated by the duty cycle calculator.

Other exemplary aspects of the present invention are put forward in view of the above-described circumstances, and provide an image forming apparatus.

Still other exemplary aspects of the present invention are put forward in view of the above-described circumstances, and provide a heater control method.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
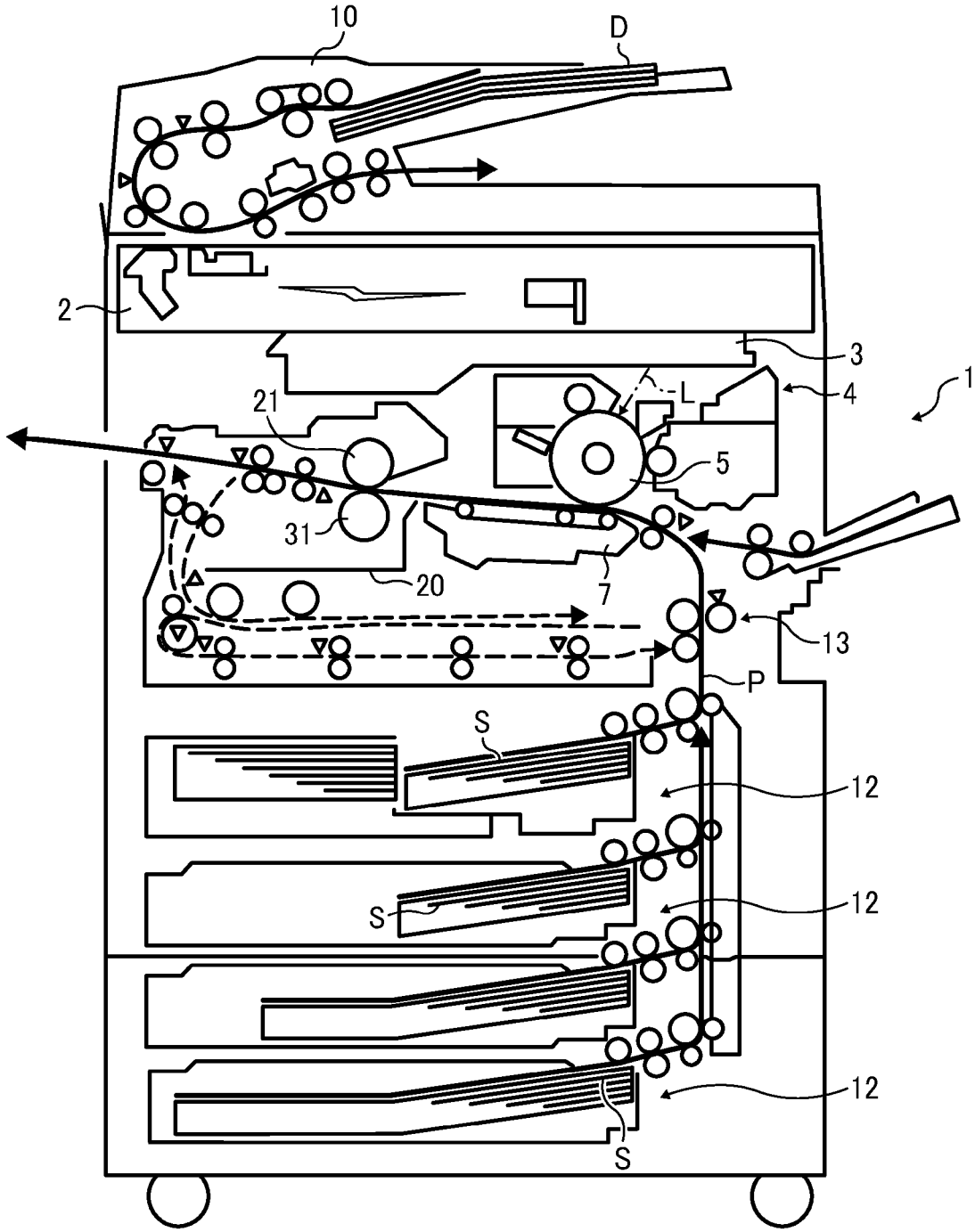
FIG. 1 schematically illustrates an image forming apparatus according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 according to one embodiment of this patent specification.

As shown in FIG. 1, the image forming apparatus 1 in the present embodiment comprises a photocopier including an image scanner 2 for optically capturing information from an original document D; an exposure device 3 that generates a beam of light, such as a laser beam L, for creating an electrostatic latent image on a photoconductive surface according to the image information output from the image scanner 2; an imaging unit 4 including a drum-shaped photoconductor 5 upon which the electrostatic latent image is developed using toner; a transfer unit 7 for transferring the toner image from the photoconductive surface to a recording medium such as a sheet of paper S; and a fixing device 20 including a pair of opposed, fixing rollers 21 and 31, one internally heated and the other pressed against the heated one to define a fixing nip N therebetween, through which the recording sheet S is passed to fix the toner image in place.

Also included in the image forming apparatus 1 are an automatic document feeder 10 located above the image scanner 2, which includes multiple feed rollers for automatically feeding a user-input document D for optical scanning; one or more input trays 12 each accommodating a stock of recording sheets S; and a pair of registration rollers 13 and various conveyor members, such as guide plates and rollers, which together define a media conveyance path P along which the recording sheet S is conveyed from the input tray 12, through the registration roller pair 13 to the transfer unit 7, and then to the fixing device 20.

During operation, the automatic document feeder 10 rotates the feed rollers to feed an original document D downward toward the image scanner 2. As the document D proceeds, the image scanner 2 scans the surface of the document D with light to obtain image information, which is converted into an electrical data signal for subsequent transmission to the exposure device 3. The exposure device 3 then irradiates the surface of the photoconductor 5 with a laser beam L modulated according to the image data signal.

In the imaging unit 4, the photoconductive drum 5 rotates in a given rotational direction (clockwise in the drawing) to undergo a series of electrophotographic processes, including charging, exposure, and development processes, in which the drum 5 has its outer, photoconductive surface initially charged to a uniform potential, and then exposed to the laser beam L to create an electrostatic latent image thereon, followed by developing the latent image into a visible toner image.

Meanwhile, the media conveyance mechanism picks up an uppermost one of the stacked sheets S in one of the input trays 12 (for example, that situated highest of the four input trays), selected either automatically or manually by the user, and feeds it into the media conveyance path P. The fed sheet S first reaches between the pair of registration rollers 13, which hold the incoming sheet S therebetween, and then advance it in sync with the movement of the photoconductive drum 5 toward the transfer device 7, at which the developed toner image is transferred from the photoconductive surface to the recording sheet S.

After transfer, the recording sheet S is introduced into the fixing device 20. In the fixing device 20, the recording sheet S passes through the fixing nip N defined between the rollers 21 and 22, at which the toner image is fixed in place on the sheet S under heat from the heated roller 21 and pressure between the opposed rollers 21 and 31. Upon exiting the fixing nip N, the recording sheet S is directed to outside from the apparatus body for user-pickup, which completes one operational cycle of the image forming apparatus 1.

Figure 2:
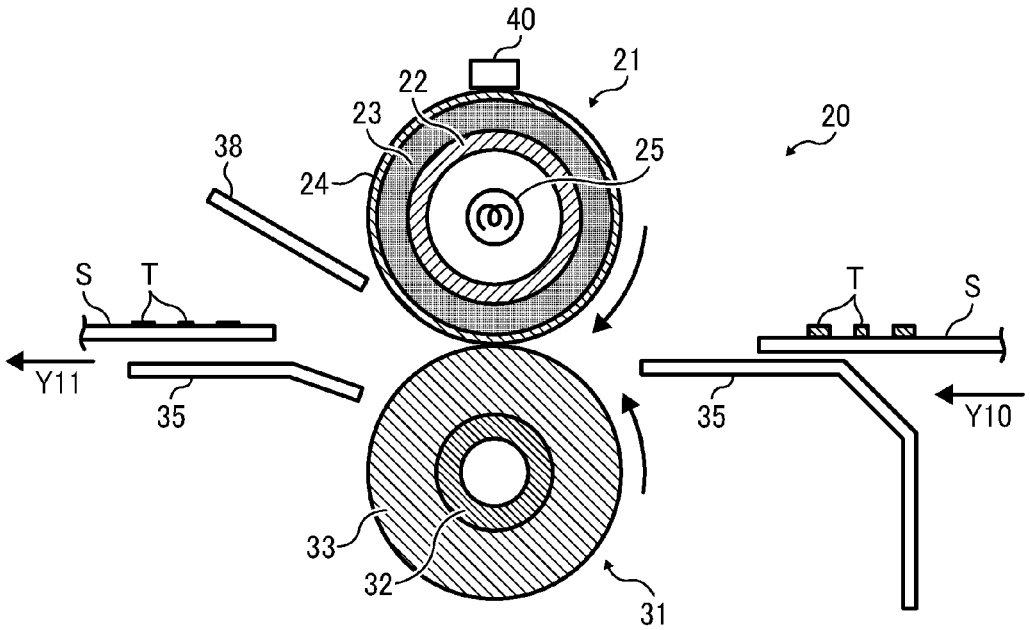
FIG. 2 is an end-on, axial cutaway view schematically illustrating a fixing device according to one embodiment of this patent specification.

FIG. 2 is an end-on, axial cutaway view schematically illustrating the fixing device 20 according to one embodiment of this patent specification.

As shown in FIG. 2, the fixing device 20 includes an internally heated fuser roller 21, and a pressure roller 31 pressed against the fuser roller 21 to form a fixing nip N therebetween. A pair of guide plates 35, one extending toward and the other extending away from the fixing nip N, is provided to guide a recording sheet S conveyed in a sheet conveyance direction Y through the fixing nip N. A sheet stripper 38 may be disposed adjoining an outer circumferential surface of the fuser roller 21 downstream from the fixing nip N to prevent the recording sheet S from winding around the roller surface upon exiting the fixing nip N.

The fixing device 20 also includes a heater 25 disposed stationary in the fuser roller 21 to heat the roller body from inside. A thermometer 40 is disposed in contact with the fuser roller 21 to detect an operational temperature of the roller 21.

Stationary components of the fixing device 20, including the heater 25 and the guide plates 35, are affixed to sidewalls defining an enclosure of the fixing device 20.

In the present embodiment, the fuser roller 21 comprises a thin-walled tubular, rotatable body within which the heater 25 is accommodated, consisting of a hollow cylindrical core of metal 22 on which an intermediate elastic layer 23 and an outer coating of release agent 24 are deposited one upon another to form a multilayered structure.

The cylindrical core 22 of the roller 21 is formed of suitable metal, such as type SUS304 stainless steel or other iron-based material. The elastic layer 23 of the roller 21 is formed of a suitable elastic material, such as solid or foamed silicone rubber, fluorine rubber, or the like. The coating 24 of the roller 21 may be formed of a suitable release agent, such as tetrafluoroethylene-perfluoro alkylvinyl ether copolymer (PFA), polytetrafluoroethylene (PTFE), polyimide (PI), polyetherimide (PEI), polyethersulfide (PES), or the like, which provides good releasability of toner from the roller surface to facilitate ready separation of a recording sheet S from the roller.

The heater 25 comprises an electrically operated heating element, such as an elongated halogen lamp, with its opposed longitudinal ends secured to the sidewalls of the fixing device 20. The heater 25 is connected to an alternating current (AC), mains power source provided in the image forming apparatus 1. Power supply to the heater 25 is controlled through power control circuitry connected between the heater 25 and the mains power source, which adjusts a period of time during which the heater 25 is supplied with the AC voltage according to readings of the thermometer 40, so as to maintain the operational temperature of the fuser roller 21 at a desired, set-point temperature. The thermometer 40 may be any suitable temperature detector, including those that operate in contact with the object surface, such as a thermistor, and those that operate without touching the object surface, such as a thermopile.

According to this patent specification, the control circuitry incorporates a phase-fired control capability that can "soft start" and "soft stop" the heater 25 by gradually changing the rate of power supply to the heater 25 for preventing variations in the mains voltage and concomitant adverse effects on other AC-powered systems, while compensating for a discrepancy between calculated and effective duty cycles upon soft start and soft stop of the heater. A description of such power supply control and its associated structure will be given later in more detail with reference to FIG. 3, and subsequent drawings.

The pressure roller 31 comprises an elastically biased cylindrical rotatable body, consisting of a cylindrical core of metal 32 on which an elastic layer 33 is deposited and bonded via an intervening layer of adhesive therebetween.

The elastic layer 33 of the roller 31 is formed of a suitable elastic material, such as solid or foamed silicone rubber, fluorine rubber, or the like. An optional, outer coating of release agent, such as PFA, may be deposited upon the elastic layer 33 to form a multilayered structure. A suitable biasing mechanism, such as a spring-loaded lever, is connected to the metal core 32, which presses the pressure roller 31 against the fuser roller 21 to establish the fixing nip N therebetween.

During operation, upon activation of the image forming apparatus 1, the power supply starts supply of AC voltage to the heater 25, whereas a rotary driver rotates the fuser roller 21 to rotate in one rotational direction (i.e., clockwise in the drawing) and the pressure roller 31 in another, opposite rotational direction (i.e., counterclockwise in the drawing).

Then, a recording sheet S bearing an unfixed, powder toner image enters the fixing nip N in a sheet conveyance direction Y10. During passage of the recording sheet S through the fixing nip N, heat from the fuser roller 21 causes toner particles to fuse and melt, while pressure between the fuser and pressure rollers 21 and 31 causes the molten toner to penetrate into the printed surface of the recording sheet S, thereby fixing the toner image in place on the recording sheet S. After fixing, the recording sheet S moves forward in a sheet conveyance direction Y11 to exit the fixing nip N as the rotary fixing members rotate together.

Figure 3:
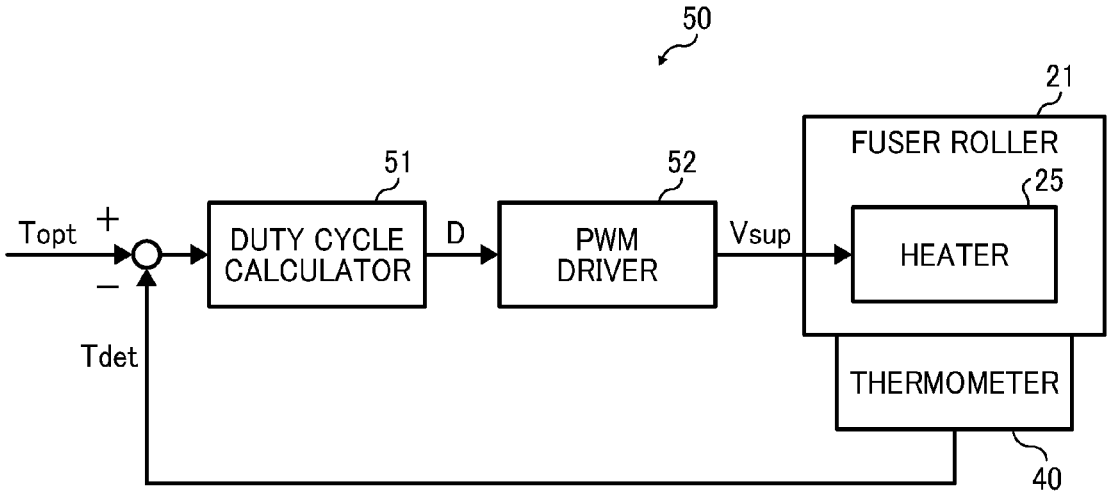
FIG. 3 is a block diagram illustrating power control circuitry of the fixing device of FIG. 2.

FIG. 3 is a block diagram illustrating the power control circuitry of the fixing device 20.

As shown in FIG. 3, the power control circuitry comprises a proportional-integral-derivative or -differential (PID) feedback controller 50 that controls a power supply voltage Vsup supplied to the heater 25 of the fuser roller 21 by adjusting a duty cycle D defining a ratio of on-time during which the heater 25 is supplied with electricity within a given control cycle according to an operational temperature Tdet of the fuser roller 21 detected by the thermometer 40, so as to adjust the roller operational temperature Tdet to a desired, optimal set-point temperature Topt as the image forming apparatus 1 operates in warm-up, stand-by, and print or copying modes.

Specifically, the controller 50 includes a duty cycle calculator 51 operatively connected to the thermometer 40 to calculate a primary duty cycle Dcal based on the operational temperature Tdet detected by the thermometer 40, and a pulse width modulation (PWM) driver circuit 52 operatively connected to the duty cycle calculator 51 and an external, AC power source to supply power to the heater 21 according to the duty cycle Dcal being input from the duty cycle calculator 51 during operation of the heater 25.

During operation, the calculator 51 compares the operational temperature Tdet detected by the thermometer 40 against the optimal temperature Topt for the specific mode of operation to output the calculated duty cycle Dcal based on a difference between the received temperatures Tdet and Topt. The calculated duty cycle Dcal is forwarded to the PWM circuit 52, which accordingly controls the amount of power supply voltage Vsup conducted across the heater 25 from the AC power source within a specific control cycle.

In the present embodiment, the duty cycle calculator 51 comprises a PID calculator that employs an algorithm involving proportional, integral, and derivative terms to calculate the duty cycle for output to the PWM circuit 52 driving the heater 21. Alternatively, instead of such PID calculation, the duty cycle calculation may be accomplished using any suitable control algorithm, including PI control, I-PD control, I-P control, or PI-D control, either of which may be used with suitable modification to the control circuitry, so as to obtain good responsiveness to an error, and high protection against ripples, overshoot/undershoot, and other fluctuations in the output temperature.

Figure 4:
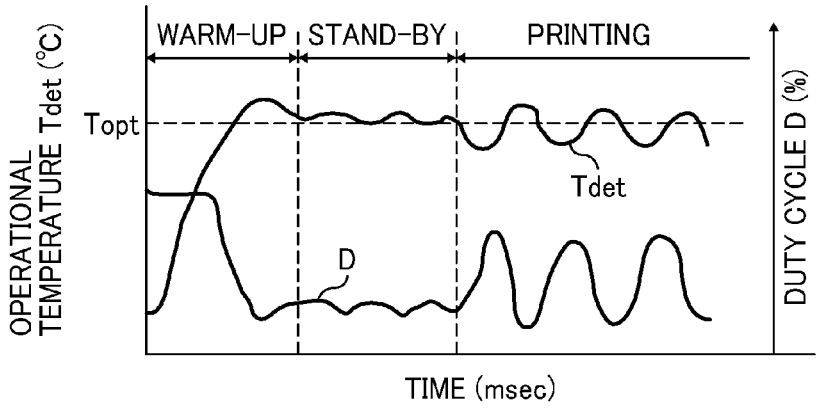
FIG. 4 is a graph showing an operational temperature in degrees Celsius and a duty cycle in percent, both plotted against time in milliseconds during operation of the fixing device.

FIG. 4 is a graph showing the operational temperature Tdet, in degrees Celsius, of the fuser roller 21, and the duty cycle D, in percent, output from the duty cycle calculator 51 of the power supply controller 50, both plotted against time, in milliseconds, during operation of the fixing device 20, where the image forming apparatus 1 switches from the warm-up mode to the stand-by mode, and then to the printing mode.

As shown in FIG. 4, the temperature Tdet exhibits a greater tendency to fluctuate from the desired temperature Topt during printing than during warm-up or stand-by, since the recording sheet S passing through the fixing nip N deprives the fuser roller 21 of a substantial amount of heat for fusing the toner image thereon. Determined based on the operational temperature Tdet, the resultant duty cycle D fluctuates more extensively during printing than during warm-up or stand-by.

Figure 5:
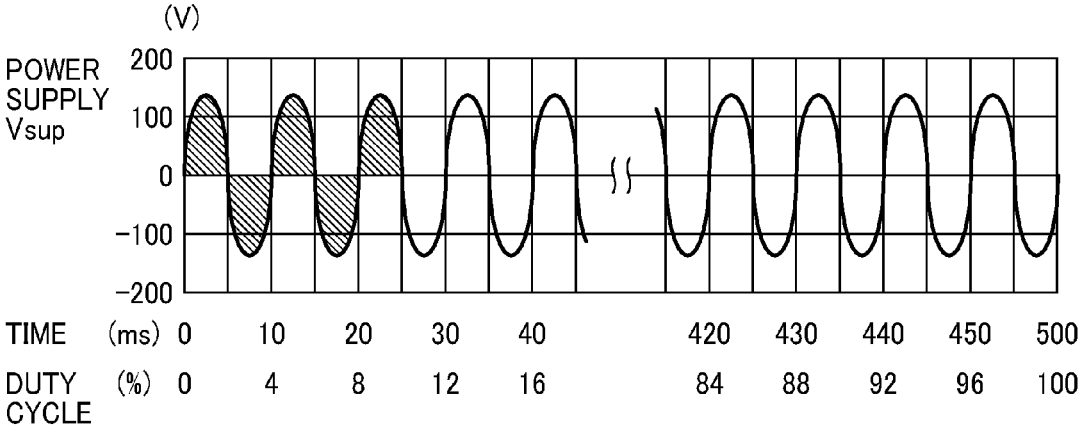
FIG. 5 is a graph showing a power supply voltage applied to a heater through a PWM circuit of the power supply controller.

FIG. 5 is a graph showing the power supply voltage Vsup, in volts, applied to the heater 25 through the PWM circuit 52 of the power supply controller 50, wherein the heater 25 is operated at a control cycle of 500 milliseconds and a duty cycle of 10%, with the AC power source supplying a voltage of approximately 100 V with a frequency of 50 Hz.

As shown in FIG. 5, the power supply voltage Vsup is applied during initial 25 msec within the control cycle, and switched off for the rest of the control cycle to yield the 10%-duty ratio as indicated by shaded portions of the waveform diagram.

A drawback of PID control is that it can cause a large inrush current to flow into the heating element of the fixing process, particularly where the heater employed is one that consumes relatively large amounts of energy, such as a halogen heater. Inrush current surge results in fluctuations in a mains voltage from which the heater derives power, which causes lighting devices, such as fluorescent lamps and light bulbs, connected to the mains voltage in common with the printer, to flicker or dim upon activation of the heating element.

Flickering or dimming of lights due to inrush current is particularly pronounced where the lighting device is of the type employing a relatively thin filament, such as those for use with a voltage rating of 200V as is often the case in European countries, and where the mains wiring exhibits a high impedance. Fluctuations in the mains voltage can also take place upon deactivation of the heating system.

To alleviate drawbacks of PID-control heating, the control circuit 50 according to this patent specification incorporates a phase-fired control capability that modulates the duty cycle, or phase angle, to gradually increase from a basic value to the calculated primary value Dcal upon initial application of power during activation of the heater, and gradually decreased from the calculated primary value Dcal to a basic value upon final application of power during deactivation of the heater.

Specifically, the control circuit 50 can "soft start" the heater 25, in which the duty cycle gradually ramps up to a predetermined constant during several tens of milliseconds after initial application of power to the heater 25, thereby preventing sudden variations in current flow. The control circuit 50 also can "soft stop" the heater 25, in which the duty cycle gradually ramps down to a predetermined constant during several milliseconds before stopping supply of power to the heater 25, thereby preventing sudden variations in current flow.

More specifically, in the present embodiment, the PWM driver circuit 52 is configured to generate a trigger pulse that causes a switching element, such as a triac, disposed between the AC power source and the heater to turn on at an adjustable phase angle and turn off at a zero-crossing in each half cycle of the applied waveform voltage during activation and deactivation of the heater. The phase angle at which the switching element switches on the power supply is incremented or decremented in steps depending on whether the heater is activated or deactivated.

Figure 6:
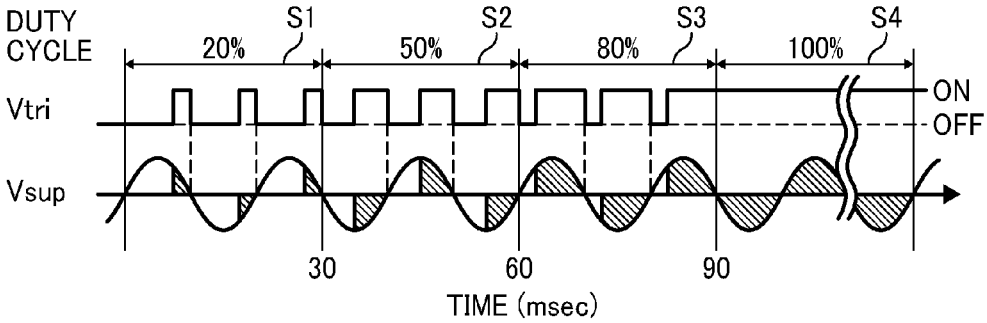
FIG. 6 is a waveform diagram showing a trigger pulse signal, plotted against time in milliseconds, output from the PWM driver circuit.
Figure 7:
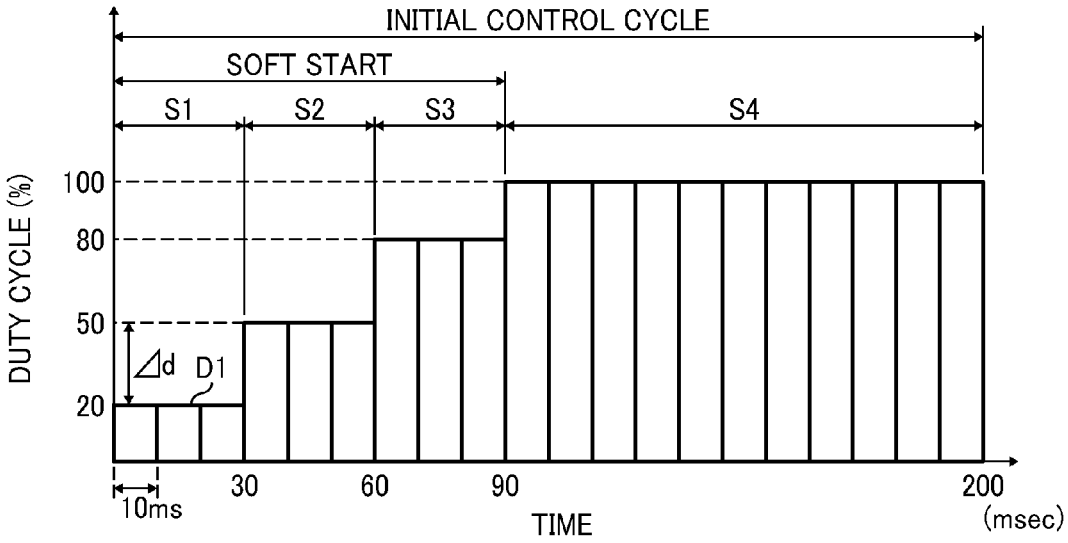
FIG. 7 is a graph showing the duty cycle, plotted against time in milliseconds, incrementing during an initial control cycle upon activation of the heater.

FIG. 6 is a waveform diagram showing a trigger pulse signal Vtri, plotted against time in milliseconds, output from the PWM driver circuit 52 to control application of a power supply voltage Vsup oscillating with a period of 20 msec to activate the heater 25, and FIG. 7 is a graph showing the duty cycle, plotted against time in milliseconds, incrementing during an initial control cycle upon activation of the heater 25.

As shown in FIGS. 6 and 7, activation of the heater 25 is carried out in multiple, discrete stages within the initial control cycle, each of which includes a predetermined number of half-cycles (i.e., the interval of time between two consecutive zero-crossings) of the waveform voltage Vsup. That is, the initial control cycle contains a series of first through third, soft start stages 51 through S3, each having a duration of 30 msec corresponding to a total of three half-cycles of the waveform voltage Vsup, followed by a fourth, post-soft start stage S4 which lasts until the end of the initial control cycle upon power-up.

Three adjustable parameters exist with which the phase controller carries out soft start and soft stop: conduction frequency F, initial phase angle or duty cycle D1, and phase-angle increment or decrement Δd. The conduction frequency F is defined as a number of times the phase controller allows conduction of power supply from the power source to the heater during each stage of the initial or final control cycle, which equals the number of AC half-waves contained in each stage where conduction is triggered once in each half-cycle of the power supply voltage. The initial duty cycle D1 is a phase angle at which conduction is triggered within each half-cycle of the power supply voltage during the first stage of the initial or final control cycle. The phase-angle increment or decrement Δd is an amount by which the phase angle or duty cycle changes from one stage to another of the initial or final control cycle during soft start or soft stop.

For example, in the present embodiment, the phase controller has a conduction frequency F of three times per stage, an initial duty cycle D1 of 20%, and a phase-angle increment Δd of 30%. With the parameters thus specified, the trigger signal Vtri pulses three times per stage with its duty cycle gradually ramping from the initial duty D1 of 20% at the first stage S1, to 50% at the second stage S2, then to 80% at the third stage S3, and finally to 100% at the fourth stage S4.

With continued reference to FIG. 6, the power supply voltage Vsup is switched on and off within each half-cycle of the AC waveform throughout the first through third, soft start stages S1 through S3. Such switching control results in a total amount of electricity supplied to the heater during activation (indicated by shaded portions in the waveform diagram) to fall below that supplied during normal operation of the heater. That is, during soft start, a discrepancy occurs between a calculated duty cycle output from the PID controller and an effective, actual duty cycle with which the heater is activated.

Table 1 below shows an example of comparison between a PID-calculated duty cycle and an effective duty cycle obtained in a conventional system.

TABLE 1

| Calculated duty cycle (%) | Effective duty cycle (%) |
|---|---|
| 5 | 1 |
| 10 | 2 |
| 30 | 11 |
| 50 | 28 |

As shown in Table 1, with the conventional PID control, the effective duty cycle can drop to only 20 to 60% of the calculated duty cycle. Such a discrepancy between the calculated and effective duty cycles, if not corrected, eventually result in variations in the amount of heat generated per unit of time, leading to deviation of the operational temperature from a desired, set-point temperature.

A problem encountered by conventional phase-fired control of a heating system is variations in the operational temperature during soft start or soft stop, due to failure in maintaining a proper, linear relation between the duty cycle and the heat output required, resulting in a significant drop in the operational temperature of the fixing member.

That is, soft starting or soft stopping the heater causes the effective duty cycle to fall below 100%, which reduces the period of time within which the heater is fully on during an initial control cycle upon activation of the heater. Insofar as the control cycle is sufficiently long relative to the duration of soft start or soft stop, a slight reduction in the effective duty cycle may not lead to a significant failure in optimizing the operational temperature of the heater. However, this is not the case with today's fast, thermally-efficient fixing process that employs a fixing member of low heat capacity to obtain short warm-up time and low energy consumption, which necessitates a shorter control cycle of the heating controller relative to the duration of soft start or soft stop.

To compensate for a discrepancy between calculated and effective duty cycles upon soft start and soft stop of the heater, the power supply controller 50 of the fixing device 20 according to this patent specification can modify the duty cycle primarily calculated by the duty cycle calculator for output to the driver circuit. A description is now given of such duty cycle modification and its associated structure with reference to FIG. 8 and subsequent drawings.

Figure 8:
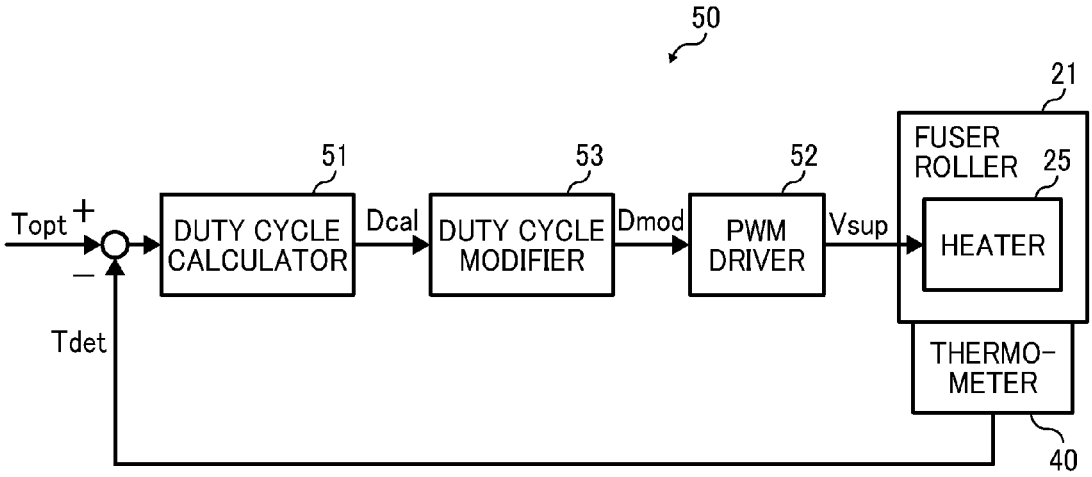
FIG. 8 is a block diagram illustrating the power control circuitry of the fixing device with duty cycle modification according to one or more embodiments of this patent specification.

FIG. 8 is a block diagram illustrating the power control circuitry of the fixing device 20 with duty cycle modification according to one or more embodiments of this patent specification.

As shown in FIG. 8, and as described earlier, the power supply controller 50 has the duty cycle calculator 51 operatively connected to the thermometer 40 to calculate a primary value Dcal of the duty cycle based on the operational temperature Tdet detected by the thermometer 40, and the driver circuit 52 operatively connected to the duty cycle calculator 51 to supply power to the heater 25 according to the duty cycle being input from the duty cycle calculator 51 during operation of the heater 25. The controller 50 can perform phase-fired control, in which the duty cycle gradually is increased to the primary value upon initial application of power during activation of the heater, and gradually decreased from the primary value upon final application of power during deactivation of the heater.

In addition to the duty cycle calculator 51 and the driver circuit 52, the power supply controller 50 includes a duty cycle modifier 53 connected between the duty cycle calculator 51 and the driver circuit 52 to modify the duty cycle output from the duty cycle calculator 51. The duty cycle modifier 53 adds an additional, offset value to the primary value Dcal to output a modified, secondary value Dmod of the duty cycle to the driver circuit 40 during activation or deactivation of the heater 25, such that a total period of on-time divided by the control cycle during activation or deactivation of the heater 25 equals the primary value Dcal of the duty cycle calculated by the duty cycle calculator 51. The modified duty cycle Dmod is forwarded to the PWM driver 52, which accordingly controls the amount of power supply voltage Vsup conducted across the heater 25 from the AC power source within a specific control cycle.

Components of the power supply controller 50, including the duty cycle calculator 51, the driver circuit 52, and the duty cycle modifier 53, may be implemented, either individually or in combination, on a central processing unit (CPU) and associated memory devices for data storage and executing of computer programs.

In the present embodiment, the duty cycle modifier 53 determines the offset value to be added to the primary value Dcal of the duty cycle based on reference to a lookup table that associates the primary value of the duty cycle for the current control cycle with the offset value of the duty cycle. An example of such correction table is provided in Table 2 below.

TABLE 2

| Calculated duty cycle (%) | Offset duty cycle (%) | Soft start period required (msec) | Total on-time during soft start (msec) | Effective duty cycle (%) |
|---|---|---|---|---|
| 5 | 15 | 30 | 9 | 6 |
| 10 | 20 | 50 | 19 | 11 |
| 30 | 25 | 90 | 45 | 33 |
| 50 | 25 | 90 | 45 | 53 |

Alternatively, instead of referring to the correction table, the duty cycle modifier 53 may determine the offset value to be added to the primary value Dcal of the duty cycle based on calculation involving control parameters, such as conduction frequency F, initial phase angle or duty cycle D1, and/or phase-angle increment or decrement Δd, which are dependent on the duty cycle of a preceding control cycle. For example, the offset value may be calculated from the primary duty cycle and the duty cycle of a preceding control cycle, using the following equation:

$$Deff=[p*F1*D1/100+p*F2*D2/100+\ldots+p*Fn*Dn/100+P*(Dcal+Doff)/100-p*(F1+F2+\ldots+Fn)]*100/P \quad \text{Equation 1}$$

where "Deff" represents an effective duty cycle in %, "n" represents a total number of stages in which the soft start or soft stop is carried out, "p" represents a period of time in msec during each half-cycle of the power supply voltage, "Fx" represents a conduction frequency of the x-th stage, "Dx" represents a duty cycle in % of the x-th stage, "P" represents a period of time in msec during the entire control cycle, "Dcal" represents a calculated primary value of the duty cycle in %, and "Doff" represents an offset duty cycle in %.

In further embodiment, the duty cycle modifier 53 may be configured to modify not only the magnitude of the duty cycle but also different parameters determining the effective duty cycle depending on the primary value of the duty cycle.

For example, the duty cycle modifier 53 may modify, depending on the primary value of the duty cycle, a period of time during which the duty cycle is gradually increased or decreased upon activation or deactivation of the heater.

Figure 9:
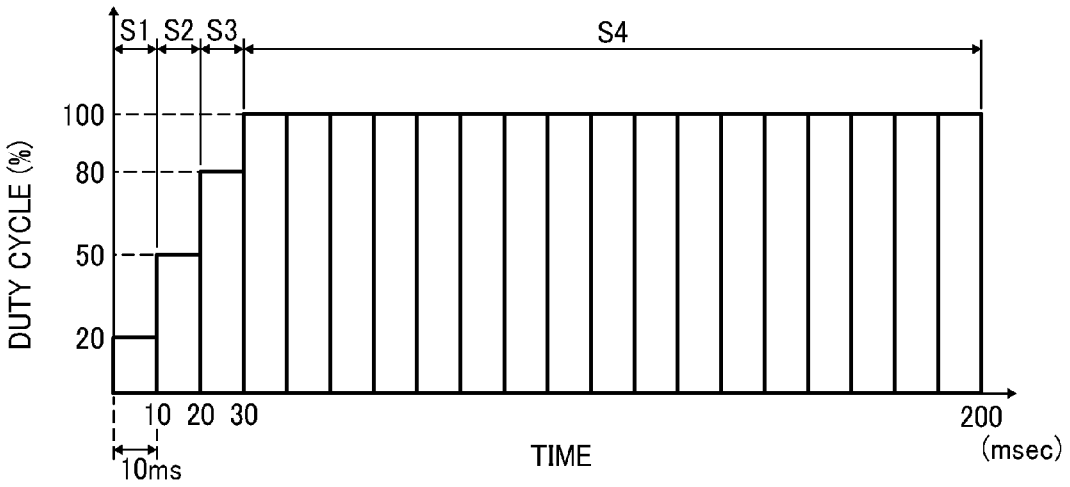
FIG. 9 is a graph showing the duty cycle, plotted against time in milliseconds, which is modified through duty cycle modification according to one embodiment of this patent specification.

An example of such duty cycle modification is shown in FIG. 9 and Table 3 below, in which the period of time required to soft start the heater 25 (i.e., the total period of the first to third soft start stages S1 through S3) is reduced from 90 msec to 30 msec, resulting in an effective duty cycle of approximately 90%. Such arrangement allows for effective equalization of the calculated and effective duty cycles where the calculated duty cycle is relatively high.

TABLE 3

| Calculated duty cycle (%) | Offset duty cycle (%) | Soft start period required (msec) | Total on-time during soft start (msec) | Effective duty cycle (%) |
|---|---|---|---|---|
| 90 | 10 | 30 | 15 | 93 |

Further, the duty cycle modifier 53 may modify, depending on the primary value of the duty cycle, a period of time during which the heater is powered on as the duty cycle is gradually increased or decreased upon activation or deactivation of the heater 25. Stated otherwise, the duty cycle modifier may modify an increment or decrement by which the duty cycle gradually changes upon activation or deactivation of the heater 25.

Figure 10:
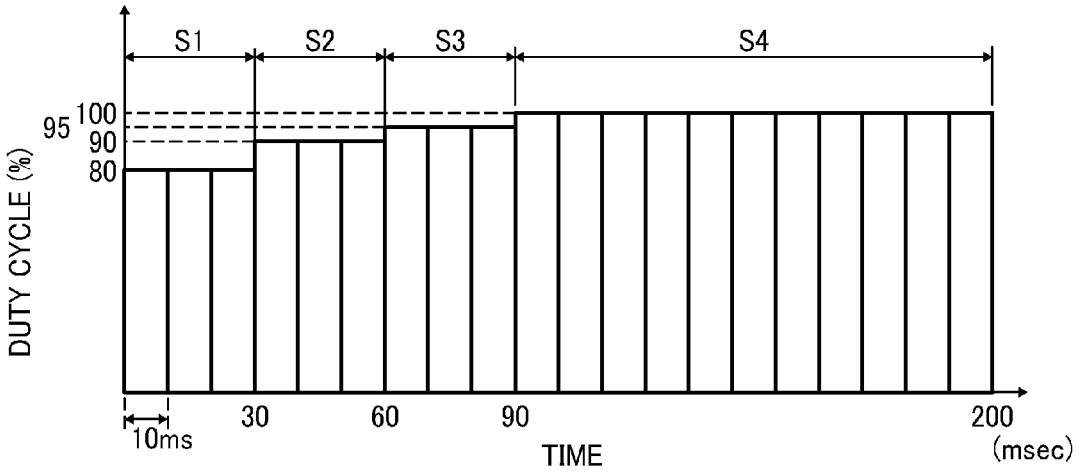
FIG. 10 is a graph showing the duty cycle, plotted against time in milliseconds, which is modified through duty cycle modification according to another embodiment of this patent specification.

An example of such duty cycle modification is shown in FIG. 10 and Table 4 below, in which the total period of time during which the heater 25 is supplied with power during soft start (i.e., the total on-time throughout the first to third soft start stages S1 through S3) is increased from 45 msec to 80 msec, resulting in an effective duty cycle of approximately 90%.

TABLE 4

| Calculated duty cycle (%) | Offset duty cycle (%) | Soft start period required (msec) | Total on-time during soft start (msec) | Effective duty cycle (%) |
|---|---|---|---|---|
| 90 | 5 | 90 | 80 | 90 |

Modifications to the soft start/soft stop period and to the total on-time during soft start/soft stop described above may be performed either separately or in conjunction with each other depending on specific configuration of the power supply controller 50.

In still further embodiment, the duty cycle modifier 53 may limit the secondary value Dmod of the duty cycle not to exceed, or fall below, the primary value Dcal of the duty cycle upon activation of the heater 25.

Figure 11:
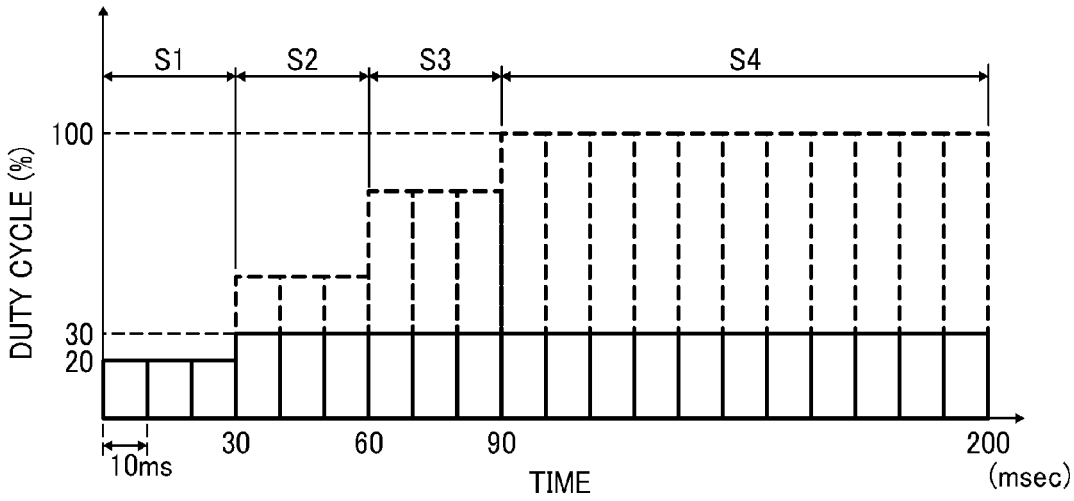
FIG. 11 is a graph showing the duty cycle, plotted against time in milliseconds, which is modified through duty cycle modification according to still another embodiment of this patent specification.

An example of such duty cycle modification is shown in FIG. 11, in which the modified duty cycle is limited to an upper limit of 30%, which is the calculated, primary duty cycle output from the duty cycle calculator 51. Such arrangement allows for effective equalization of the calculated and effective duty cycles where the calculated duty cycle is relatively low.

Hence, the fixing device according to this patent specification can reliably control the operational temperature of the fuser member, in which the control circuitry incorporates a phase-fired control capability that can soft start and soft stop the heater for preventing variations in the mains voltage and concomitant adverse effects on other AC-powered systems, while compensating for a discrepancy between calculated and effective duty cycles upon soft start and soft stop of the heater.

Although specific embodiments have been illustrated and described herein, any arrangement calculated to achieve the same purpose may be substituted for the specific embodiments shown. Thus, the fixing device according to this patent specification is applicable to any type of fixing process, including not only roller-based assemblies but also belt-based assemblies, which can fix a toner image in place on a recording medium using a fuser member subjected to heating.

Also, values of duty cycle and other control parameters are not limited to those specifically disclosed, and can be changed depending on various parameters, such as capabilities of the heater or heat source, the heat capacity of the fuser member, and the set-point temperature specified. For example, contents of the lookup correction table used in duty cycle modification may be different from those provided in Table 2. Another example of the correction table is provided in Table 5, in which specific values of offset duty cycle are calculated for a control cycle of 1000 msec.

TABLE 5

| Calculated duty cycle (%) | Total on-time during control cycle (msec) | Effective duty cycle before modification (%) | Offset duty cycle (%) | Effective duty cycle after modification (%) |
|---|---|---|---|---|
| 0 | 0 | 0 | 0 | 0 |
| 10 | 10 | 1 | 9 | 10 |
| 20 | 30 | 3 | 17 | 20 |
| 30 | 140 | 14 | 16 | 30 |
| 40 | 230 | 23 | 17 | 40 |
| 50 | 330 | 33 | 17 | 50 |
| 60 | 430 | 43 | 17 | 60 |
| 70 | 540 | 54 | 16 | 70 |
| 80 | 650 | 65 | 15 | 80 |
| 90 | 760 | 76 | 14 | 90 |
| 99 | 850 | 85 | 14 | 99 |
| 100 | 1000 | 100 | 0 | 100 |

Further, the image forming apparatus according to this patent specification may be configured otherwise than that described herein, and is applicable to any type of image formation, including not only monochrome imaging systems but also multicolor or full-color imaging systems, configured in the form of a photocopier, facsimile machine, printer, plotter, or multifunctional machine incorporating several of those features.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device, comprising:

a fuser member subjected to heating;

a heater provided in the fuser member to heat the fuser member;

a thermometer adjacent to the fuser member to detect an operational temperature of the fuser member; and a power supply controller to control power supply to the heater by adjusting a duty cycle defining a ratio of on-time during which the heater is supplied with electricity within a given control cycle, the controller including:

a duty cycle calculator operatively connected to the thermometer to calculate a primary value of the duty cycle based on the operational temperature detected by the thermometer;

a driver circuit operatively connected to the duty cycle calculator to supply power to the heater according to the duty cycle being input from the duty cycle calculator during operation of the heater, the duty cycle being gradually increased to the primary value upon initial application of power during activation of the heater, and gradually decreased from the primary value upon final application of power during deactivation of the heater; and a duty cycle modifier connected between the duty cycle calculator and the driver circuit to modify the duty cycle by adding an offset value to the primary value to output a modified, secondary value of the duty cycle during activation or deactivation of the heater, such that a total period of on-time divided by the control cycle during activation or deactivation of the heater equals the primary value of the duty cycle calculated by the duty cycle calculator, wherein the controller further includes a lookup table that associates the primary value of the duty cycle with the offset value of the duty cycle, and the duty cycle modifier determines the offset value to be added to the primary value of the duty cycle based on reference to the lookup table.

2. The fixing device according to claim 1, wherein the duty cycle modifier determines the offset value to be added to the primary value of the duty cycle based on calculation from the primary value of the duty cycle and the duty cycle of a preceding control cycle.

3. The fixing device according to claim 1, wherein the duty cycle modifier modifies, depending on the primary value of the duty cycle, a period of time during which the duty cycle is gradually increased or decreased upon activation or deactivation of the heater.

4. The fixing device according to claim 1, wherein the duty cycle modifier modifies, depending on the primary value of the duty cycle, a period of time during which the heater is powered on as the duty cycle is gradually increased or decreased upon activation or deactivation of the heater.

5. The fixing device according to claim 1, wherein the duty cycle modifier modifies, depending on the primary value of the duty cycle, an increment or decrement by which the duty cycle gradually changes upon activation or deactivation of the heater.

6. The fixing device according to claim 1, wherein the duty cycle modifier limits the secondary value of the duty cycle not to exceed the primary value of the duty cycle upon activation of the heater.

7. The fixing device according to claim 1, wherein the duty cycle modifier limits the secondary value of the duty cycle not to fall below the primary value of the duty cycle upon deactivation of the heater.

8. The fixing device according to claim 1, wherein the power supply controller comprises a phase-fired controller.

9. The fixing device according to claim 1, wherein the duty cycle calculator comprises at least one selected from the group consisting of a PID calculator, a PI calculator, an I-PD calculator, I-P calculator, and a PI-D calculator.

10. The fixing device according to claim 1, wherein the driver circuit comprises a pulse width modulation circuit.

11. An image forming apparatus, comprising:

an imaging unit to form a toner image on a recording medium:

a fixing device to fix the toner image in place on the recording medium, the fixing device including:

a fuser member subjected to heating;

a heater provided in the fuser member to heat the fuser member;

a thermometer adjacent to the fuser member to detect an operational temperature of the fuser member; and a power supply controller to control power supply to the heater by adjusting a duty cycle defining a ratio of on-time during which the heater is supplied with electricity within a given control cycle, the controller including:

a duty cycle calculator operatively connected to the thermometer to calculate a primary value of the duty cycle based on the operational temperature detected by the thermometer;

a driver circuit operatively connected to the duty cycle calculator to supply power to the heater according to the duty cycle being input from the duty cycle calculator during operation of the heater, the duty cycle being gradually increased to the primary value upon initial application of power during activation of the heater, and gradually decreased from the primary value upon final application of power during deactivation of the heater; and a duty cycle modifier connected between the duty cycle calculator and the driver circuit to modify the duty cycle by adding an offset value to the primary value to output a modified, secondary value of the duty cycle during activation or deactivation of the heater, such that a total period of on-time divided by the control cycle during activation or deactivation of the heater equals the primary value of the duty cycle calculated by the duty cycle calculator, wherein the controller further includes a lookup table that associates the primary value of the duty cycle with the offset value of the duty cycle, and the duty cycle modifier determines the offset value to be added to the primary value of the duty cycle based on reference to the lookup table.

12. A method for controlling power supply to a heater by adjusting a duty cycle defining a ratio of on-time during which the heater is supplied with electricity within a given control cycle, the method comprising:

detecting an operational temperature of the heater, calculating a primary value of the duty cycle based on the operational temperature detected;

supplying power to the heater according to the duty cycle during operation of the heater, gradually increasing the duty cycle to the primary value upon initial application of power during activation of the heater;

gradually decreasing the duty cycle from the primary value upon final application of power during deactivation of the heater;

adding an offset value to the primary value to output a modified, secondary value of the duty cycle during activation or deactivation of the heater, such that a total period of on-time divided by the control cycle during activation or deactivation of the heater equals the primary value of the duty cycle calculated by the duty cycle calculator;

associating a lookup table of the primary value of the duty cycle with the offset value of the duty cycle; and determining the offset value to be added to the primary value of the duty cycle based on reference to the lookup table.

* * * * *